US010362843B2

(12) United States Patent
Strnad, II et al.

(10) Patent No.: US 10,362,843 B2
(45) Date of Patent: Jul. 30, 2019

(54) GEMSTONE AND METHOD FOR CUTTING THE SAME

(76) Inventors: Leonard J. Strnad, II, Bay Village, OH (US); Yoshihiko Kodama, Markham (CA); Yoshiko Kodama, legal representative, Markham (CA)

( * ) Notice: Subject to any disclaimer, the term of this patent is extended or adjusted under 35 U.S.C. 154(b) by 1038 days.

(21) Appl. No.: 12/449,079

(22) PCT Filed: Jan. 22, 2008

(86) PCT No.: PCT/US2008/000797

§ 371 (c)(1),
(2), (4) Date: Sep. 15, 2010

(87) PCT Pub. No.: WO2009/078884

PCT Pub. Date: Jun. 25, 2009

(65) Prior Publication Data

US 2011/0000259 A1 Jan. 6, 2011

(30) Foreign Application Priority Data

Dec. 14, 2007 (JP) ..... 2007-322872

(51) Int. Cl.
*A44C 17/00* (2006.01)

(52) U.S. Cl.
CPC ..... *A44C 17/001* (2013.01)

(58) Field of Classification Search
USPC ..... 63/32
See application file for complete search history.

(56) References Cited

U.S. PATENT DOCUMENTS

| | | | |
|---|---|---|---|
| 693,084 | A | 2/1902 | Townsend |
| 712,155 | A | 10/1902 | Seddon |
| 732,119 | A | 6/1903 | Schenck |
| 839,356 | A | 12/1905 | Wood |
| 809,531 | A | 1/1906 | Schenck |
| 2,340,659 | A | 2/1944 | Goldstein |
| 2,364,031 | A | 11/1944 | Suderov |
| 3,286,486 | A | 11/1966 | Huisman et al. |
| 3,394,692 | A | 7/1968 | Sirakian |
| 3,490,250 | A | 1/1970 | Jones |
| 3,528,261 | A | 9/1970 | Jones |
| 3,534,510 | A | 10/1970 | Leibowitz |
| 3,585,764 | A | 6/1971 | Huisman |
| 3,665,729 | A | 5/1972 | Elbe |
| 3,763,665 | A | 10/1973 | Polakiewicz |
| 3,788,097 | A | 1/1974 | Elbe |
| 3,796,065 | A | 3/1974 | Watermeyer |
| 3,835,665 | A | 9/1974 | Kitchel |
| 4,020,649 | A | 5/1977 | Grossbard |
| 4,083,352 | A | 4/1978 | Andrychuk |
| 4,118,949 | A | 10/1978 | Grossbard |

(Continued)

*Primary Examiner* — Emily Morgan

(57) ABSTRACT

A gemstone is provided that has an improved brilliance, especially at the crown portion of the gemstone. The gemstone has a crown angle that is less than an ideal cut round diamond and, preferably the crown angle is less than 27 degrees. By reducing the crown angle of the gemstone, light entering one end of the crown portion may exit the opposite end of the gemstone. In addition, reducing the crown angle reduces the mass necessary for the gemstone. As a result, the gemstone has a width or diameter that corresponds to a larger mass gemstone that is cut according to conventional ideal proportions.

2 Claims, 11 Drawing Sheets

(56) References Cited

U.S. PATENT DOCUMENTS

| | | | | |
|---|---|---|---|---|
| 4,306,427 | A | 12/1981 | Urban | |
| 4,738,240 | A | 4/1988 | Liotaud et al. | |
| 5,090,216 | A | 2/1992 | Waugh | |
| 5,454,235 | A | 10/1995 | Freiesleben | |
| 5,612,102 | A | 3/1997 | Yamato | |
| 5,657,647 | A | 8/1997 | Freiesleben | |
| 5,970,744 | A | 10/1999 | Greeff | |
| 6,397,832 | B1 | 6/2002 | Shuto | |
| 6,405,562 | B1 | 6/2002 | Zimet et al. | |
| 6,422,039 | B2 | 7/2002 | Bamminger et al. | |
| 6,430,963 | B1 | 8/2002 | Friedman et al. | |
| 6,449,985 | B1 | 9/2002 | Kejejian | |
| 6,604,382 | B2 | 8/2003 | Shuto | |
| 6,694,778 | B2 * | 2/2004 | Kawabuchi et al. | 63/32 |
| 6,698,239 | B2 | 3/2004 | Samuel | |
| 6,990,833 | B2 * | 1/2006 | Smith | 63/32 |
| 7,249,471 | B2 * | 7/2007 | Kawabuchi et al. | 63/33 |
| 7,251,619 | B2 * | 7/2007 | Holloway | 705/26.41 |
| 2002/0043078 | A1 * | 4/2002 | Kawabuchi et al. | 63/32 |
| 2004/0050097 | A1 * | 3/2004 | Eisenberg | 63/32 |
| 2005/0115275 | A1 * | 6/2005 | Kedem et al. | 63/32 |
| 2005/0166635 | A1 * | 8/2005 | Kawabuchi et al. | 63/32 |
| 2007/0186586 | A1 * | 8/2007 | Matsumura et al. | 63/32 |
| 2011/0239705 | A1 * | 10/2011 | Matsumura et al. | 63/32 |

* cited by examiner

10

| θ | v | Comp | θ | v | Comp | θ | v | Comp |
|---|---|---|---|---|---|---|---|---|
| 34.50 | 0.1915 | 1 | 19.50 | 0.1534 | 0.8007 | 4.50 | 0.1218 | 0.636 |
| 34.00 | 0.1900 | 0.9924 | 19.00 | 0.1522 | 0.7949 | 4.00 | 0.1208 | 0.6308 |
| 33.50 | 0.1886 | 0.9848 | 18.50 | 0.1511 | 0.7891 | 3.50 | 0.1198 | 0.6255 |
| 33.00 | 0.1872 | 0.9773 | 18.00 | 0.1500 | 0.7833 | 3.00 | 0.1188 | 0.6203 |
| 32.50 | 0.1858 | 0.97 | 17.50 | 0.1489 | 0.7775 | 2.50 | 0.1178 | 0.6151 |
| 32.00 | 0.1844 | 0.9627 | 17.00 | 0.1478 | 0.7718 | 2.00 | 0.1168 | 0.6098 |
| 31.50 | 0.1830 | 0.9555 | 16.50 | 0.1467 | 0.7661 | 1.50 | 0.1158 | 0.6046 |
| 31.00 | 0.1816 | 0.9483 | 16.00 | 0.1456 | 0.7604 | 1.00 | 0.1148 | 0.5994 |
| 30.50 | 0.1803 | 0.9412 | 15.50 | 0.1446 | 0.7548 | 0.50 | 0.1138 | 0.5942 |
| 30.00 | 0.1789 | 0.9343 | 15.00 | 0.1435 | 0.7492 | 0.00 | 0.1128 | 0.589 |
| 29.50 | 0.1776 | 0.9273 | 14.50 | 0.1424 | 0.7436 | -0.50 | 0.1118 | 0.5837 |
| 29.00 | 0.1763 | 0.9205 | 14.00 | 0.1413 | 0.7381 | -1.00 | 0.1108 | 0.5785 |
| 28.50 | 0.1750 | 0.9137 | 13.50 | 0.1403 | 0.7325 | -1.50 | 0.1098 | 0.5733 |
| 28.00 | 0.1737 | 0.907 | 13.00 | 0.1392 | 0.727 | -2.00 | 0.1088 | 0.5681 |
| 27.50 | 0.1724 | 0.9003 | 12.50 | 0.1382 | 0.7215 | -2.50 | 0.1078 | 0.5628 |
| 27.00 | 0.1712 | 0.8937 | 12.00 | 0.1371 | 0.7161 | -3.00 | 0.1068 | 0.5576 |
| 26.50 | 0.1699 | 0.8871 | 11.50 | 0.1361 | 0.7106 | -3.50 | 0.1058 | 0.5524 |
| 26.00 | 0.1687 | 0.8807 | 11.00 | 0.1351 | 0.7052 | -4.00 | 0.1048 | 0.5471 |
| 25.50 | 0.1674 | 0.8742 | 10.50 | 0.1340 | 0.6998 | -4.50 | 0.1038 | 0.5419 |
| 25.00 | 0.1662 | 0.8678 | 10.00 | 0.1330 | 0.6944 | -5.00 | 0.1028 | 0.5366 |
| 24.50 | 0.1650 | 0.8615 | 9.50 | 0.1320 | 0.689 | -5.50 | 0.1018 | 0.5314 |
| 24.00 | 0.1638 | 0.8552 | 9.00 | 0.1309 | 0.6837 | -6.00 | 0.1008 | 0.5261 |
| 23.50 | 0.1626 | 0.849 | 8.50 | 0.1299 | 0.6783 | -6.50 | 0.0997 | 0.5208 |
| 23.00 | 0.1614 | 0.8428 | 8.00 | 0.1289 | 0.673 | -7.00 | 0.0987 | 0.5155 |
| 22.50 | 0.1602 | 0.8367 | 7.50 | 0.1279 | 0.6677 | -7.50 | 0.0977 | 0.5102 |
| 22.00 | 0.1591 | 0.8306 | 7.00 | 0.1269 | 0.6624 | -8.00 | 0.0967 | 0.5049 |
| 21.50 | 0.1579 | 0.8245 | 6.50 | 0.1258 | 0.6571 | -8.50 | 0.0957 | 0.4996 |
| 21.00 | 0.1568 | 0.8185 | 6.00 | 0.1248 | 0.6518 | -9.00 | 0.0946 | 0.4942 |
| 20.50 | 0.1556 | 0.8126 | 5.50 | 0.1238 | 0.6465 | -9.50 | 0.0936 | 0.4889 |
| 20.00 | 0.1545 | 0.8066 | 5.00 | 0.1228 | 0.6413 | -10.00 | 0.0926 | 0.4835 |

Fig. 9C

GEMSTONE AND METHOD FOR CUTTING THE SAME

CROSS-REFERENCE TO RELATED APPLICATION

The present application is a U.S. National Stage Application of International Patent Application Ser. No. PCT/US2008/000797 filed on Jan. 22, 2008, which claims priority to Japanese Patent Application No. JP2007-322872 filed on Dec. 14, 2007.

FIELD OF THE INVENTION

The invention generally relates to a gemstone and a method for cutting the same. More specifically, the invention relates to a gemstone having crown angles that improve properties of the gemstone, such as, improving the brilliance of the crown area.

BACKGROUND OF THE INVENTION

It is generally known that consumers' demand (and value) for a particular gemstone is affected by the characteristics of that gemstone, such as, carat weight, clarity, cut and color. Clarity relates to the number, location and severity of inclusions in the gemstone. Color, in the case of diamonds, for example, refers to the whiteness or fancy color of the diamond, such as blue or pink. Large gemstones without inclusions are more rare and, thus more valuable. Often, carat weight is the most important characteristic of the gemstone to consumers, as carat weight relates to the size of the gemstone. As a result, diamond cutters, for example, have long focused on carat weight when cutting diamonds from a rough diamond. Frequently, diamond cutters may cut a larger diamond, for example, a 1.0 carat diamond that is less brilliant and is far from the ideal proportions rather than cutting a more brilliant, better proportioned smaller diamond, such as a 0.95 carat diamond. The primary reason is the difference in price between a diamond slightly under one carat and an one carat diamond is significant to the diamond cutter.

The cut of the gemstone effects the brilliance of the gemstone. Consumers generally dislike non-brilliant gemstones. Accordingly, more brilliant gemstones are desirable and valuable. Brilliance is defined by external brilliance as well as internal brilliance. External brilliance generally refers to the amount of light reflected from the table or outer surface of the diamond. On the other hand, internal brilliance refers to light entering the crown or table of the gemstone and reflecting back out through the top or crown of the gemstone as dispersed light.

In response to consumer demand, diamond cutting prior to the twentieth century was primarily concerned with maximizing carat weight. In 1919, however, Marcel Tolkowsky publicized his theoretical analysis for the most attractive cut for round brilliant diamonds. Today's "ideal cut" diamonds correspond to Mr. Tolkowsky's proportions for a round brilliant diamond, which are acclaimed to produce the ideal brilliant diamond. Specifically, Mr. Tolkowsky determined that the ideal proportions for a round brilliant diamond are: a 34.5° crown angle, a 40.75° pavilion angle, a depth of 59.3% (16.2% of the depth comprised of the crown and 43.1% of the depth comprised of the pavilion), and a 53% table based on the diamonds overall diameter. These proportions are now regarded as the most brilliant and beautiful diamond dimensions.

FIG. 1 generally depicts an "ideal cut" round brilliant diamond 10. Typically, the diamond 10 has 58 facets, including a culet 7. The diamond 10 has a length (or diameter) L as shown in FIG. 1. A table 5 is located at one end of the diamond 10 and has a length LI, which is typically measured by the percentage of the total length L of the diamond 10. As set forth by Mr. Tolkowsky, the "ideal cut" diamond 10 has a table of 53%. The diamond 10 has a crown 3 extending from the table 5 to a girdle 2. The girdle 2 is located at the intersection of a pavilion 4 and the crown 3. The crown 3 intersects the girdle 2 at an angle of 34.5°.

Today, the evaluation of the cut of the diamond is determined by reviewing the total proportion, symmetry and polish of the diamond. Table 1 illustrates how diamond cuts are evaluated and classified by proportions of the diamond. Class 1 diamonds are regarded as having a nearly ideal cut, while Class 4 diamonds are regarded as having a poor cut. As shown by Table 1, diamonds corresponding to Tokowsky's proportions are regarded as Class 1 diamonds.

TABLE 1

Class 1 Through Class 4 Diamond Comparisons

| Class | 1 | 2 | 3 | 4 |
|---|---|---|---|---|
| Table | 53%-60% (stones under 0.50 ct. may go to 62%) | 61%-64% | 51%-52% 65%-70% | - 51% 70% + |
| Crown | 34 ⊐ 35– | 32--34– | 30--32– 36--37– | - 30– 37– + |
| Girdle | medium-sl. thick | thin-thick | v. thin-v. thick | ext. thin-ext. thick |
| Pavillion | 43% | 42%-44% | 41% 45%-46% | - 41% or 46%+ |
| Culet | none-medium | sl. large | large | very large |
| Finish | very good-excellent | good | fair | poor |

As illustrated in Table 1, it has been the view of diamond professionals that crown angles below 30 degrees are not desirable, and as such those diamonds are identified as Class 4 diamonds. Other characteristics negatively effecting the diamond, include changing the proportions of the pavilion and the table.

It has long been the belief of diamond professionals that an ideal cut diamond is the most brilliant diamond. Generally, light directed into an ideal cut gemstone is reflected by the pavilion. The light or at least a portion of the light returns to the table and crown and radiates out of the gemstone. Light entering the top table of the gemstone travels in a u-shape within the gemstone and exits the top of the gemstone, but light entering the crown ("C light") travels to the immediate pavilion, is then reflected to the opposite pavilion, and leaks therefrom ("Co light"). However, a small portion of C light will be reflected by the opposite pavilion and radiate from the top of the gemstone ("Ct light"). A deep cut gemstone causes light entering from the top to travel in an L-shape within the gemstone and to exit the side of the gemstone. A shallow cut gemstone causes light entering from the top to curve slightly back out the bottom of the gemstone. If light leaks or otherwise exits the sides or bottom of the gemstone, the gemstone has less brilliance.

FIGS. 2A-2C illustrate how light is reflected and refracted into, through and ultimately out of a round diamond. FIG. 2A illustrates light entering a diamond that is cut too deep, for example, deeper than the ideal diamond 10. As a result, light is lost through the pavilion 4. If the diamond is cut shallower than the ideal cut diamond 10, light does not reflect within the diamond as shown in FIG. 2B. The ideal cut diamond 10, as illustrated for example in FIG. 2C, reflects three types of light: (1) light from the table 5 to the table 5 ("T-T light"), (2) light from the crown 3 which leaks from the opposite pavilion ("C-Co light"), as well as (3) a portion of the light from the crown 3 which is reflected from the opposite pavilion to the table 5 ("C-Ct light"). The traditional ideal cut diamond 10, thus, is not fully capable of reflecting light from the crown 3 to the crown 3 ("C-C light")

Although Tolkowsky's theory has been claimed to produce the most beautiful round cut diamond 10, such diamonds tend to have a bright table 5, but a less bright crown 3, especially toward the girdle 2. As illustrated in FIGS. 3A and 3B, the ideal cut diamond 10 is bright on the table 5, but less bright on the crown 3. One of the primary reasons is that the ideal cut diamond 10 is incapable of reflecting C-C light.

Accordingly, the present invention departs from conventional diamond proportions to improve the brightness of the crown. For example, the present invention departs from the crown angles of the conventional ideal cuts in order to guide reflected light to the crown. In addition, in at least one embodiment, the present invention improves the brightness of gemstones by causing light to enter the gemstone with oblique angles as well as loosely focusing the returning light to the observer's eyes by expanding the crown angles to obtain a parabolic focal effect.

The present invention also departs from the conventional focus of the carat weight of the gemstone. By departing from the conventional diamond proportions, the present invention allows the cutting of smaller mass gemstones that have diameter sizes that typically correspond to larger mass gemstones. To this end, the present invention may also allow more well proportioned gemstones to be produced from a rough gemstone.

DESCRIPTION OF THE DRAWINGS

FIG. 9C is a chart illustrating the effect reducing the crown angle has on the volume of a gemstone in an embodiment of the present invention.

DETAILED DESCRIPTION OF AN EMBODIMENT OF THE INVENTION

The present invention relates to a gemstone and method for cutting a gemstone having improved brilliance. The present invention is applicable to any gemstone and should not be deemed as limited to any specific type, shape, or size gemstone. Although the description below may contain some specific discussion of round cut diamonds, it should be readily apparent to a person of ordinary skill in the art that the invention is applicable to any gemstone, including but not limited to natural, synthetic, faceted, precious and non-precious gemstones.

Figure 4:
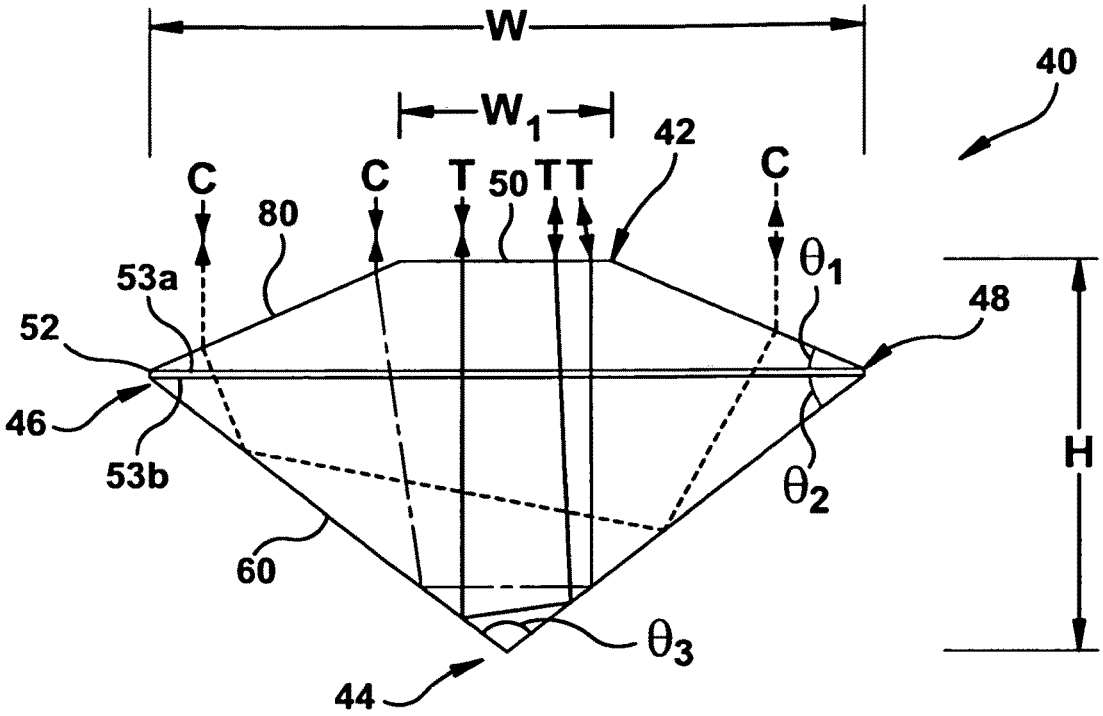
FIG. 4 illustrates a gemstone having a crown angle less than an ideal cut diamond in an embodiment of the present invention.

Referring now to the drawings, and in particular FIGS. 4-7, a gemstone 40 is generally shown. In one embodiment, the gemstone 40 is a round cut diamond. The gemstone 40, as illustrated in FIG. 4, has a height H defined between a first end 42 and a second end 44. In addition, the gemstone 40 has a width W defined between a distal end 46 and a proximate end 48.

A table 50 of the gemstone 40 is the outer surface of the diamond at or adjacent to the first end 42. The table 50 is the flat surface or facet of the gemstone 40 adjacent to the first end 42. In a preferred embodiment, the table 50 has a width W1 that is a portion or fraction of the total width W of the gemstone 40. In a round diamond, for example, the table 50 is preferably 50% to 70% of the width W of the diamond and ideally 53% to 60% of the total width W of the diamond. The table 50 of the gemstone 40 may be cut within a predetermine range to increase brilliance as will be appreciated by a person of ordinary skill in the art.

Figure 6A:
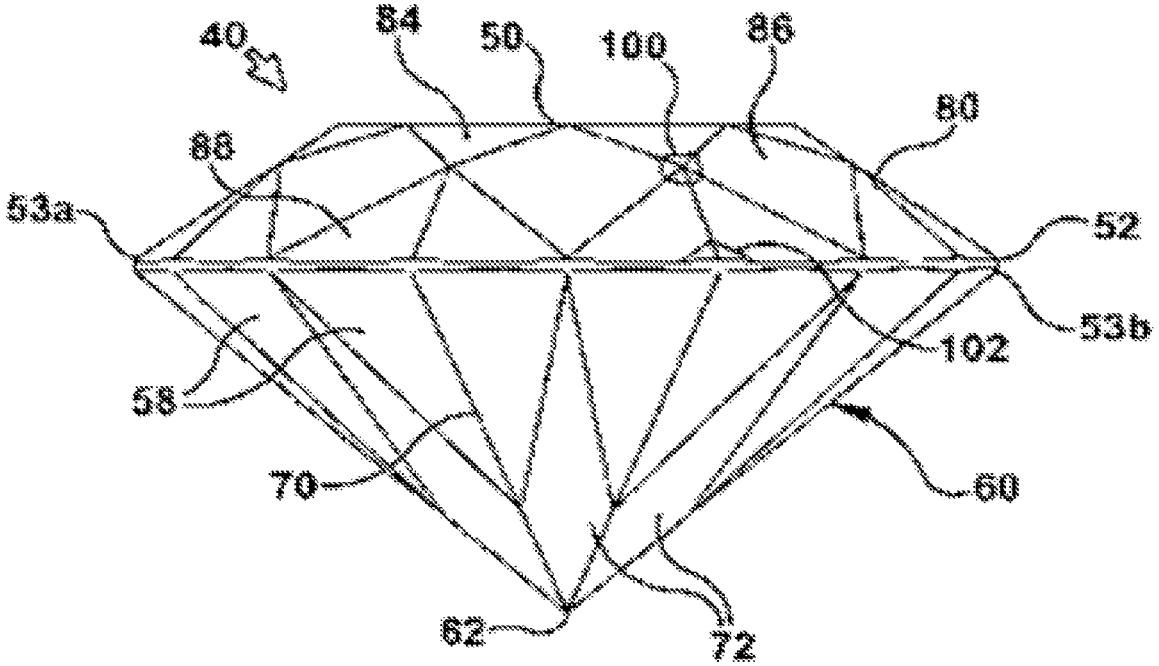
FIG. 6A illustrates the facets of the crown and the pavilion of the gemstone having a crown angle less than an ideal cut round diamond in an embodiment of the present invention.

The table 50 extends from a girdle 52 as illustrated in FIGS. 4 and 6A. The girdle 52 divides the upper portion of the gemstone 40 adjacent the first end 42 and the lower portion of the gemstone 40 adjacent the second end 44. The girdle 52 may have a thickness defined between a top edge 53*a* and a bottom edge 53*b*. The shape of the girdle 52 may correspond to the shape of the gemstone 40. In an embodiment, the gemstone 40 may be a round cut gemstone, and the girdle 52 may be substantially circular. The shape of the girdle 52 may be determined or may be the result of junctions of upper girdle facets 88 and lower girdle facets 58. The girdle 52 may be faceted, as illustrated in FIG. 6A, for example, with a slightly mountainous and valley-like facet shape.

The table 50 may be substantially parallel to the girdle 52. In an embodiment, the table 50 may be located below the top edge 53*a* and/or the bottom edge 53*b* of the girdle 52. In an embodiment, the table 50 may be positioned between the top edge 53*a* and/or the bottom edge 53*b* of the girdle 52. The table 50 may also be positioned and/or located above the top edge 53*a* and the bottom edge 53*b* of the girdle 52.

A pavilion 60 is a lower portion of the gemstone 40 that is located opposite the table 50. The pavilion 60 is generally defined between the second end 44 and the bottom edge 53*b* of the girdle 52 of the gemstone 40. The pavilion 60 may converge from the bottom edge 53*b* of the girdle 52 to a culet 62 at the second end 44. In such an embodiment, the pavilion 60 may converge at an angle $\theta_1$; that is less than 90°, and in one embodiment is preferably 40.75° with respect to the bottom edge 53*b* of the girdle 52. The culet 62 may have an angle $\theta_1$ that is less than 180°, and in an exemplary embodiment is 98.50°.

Figure 11:
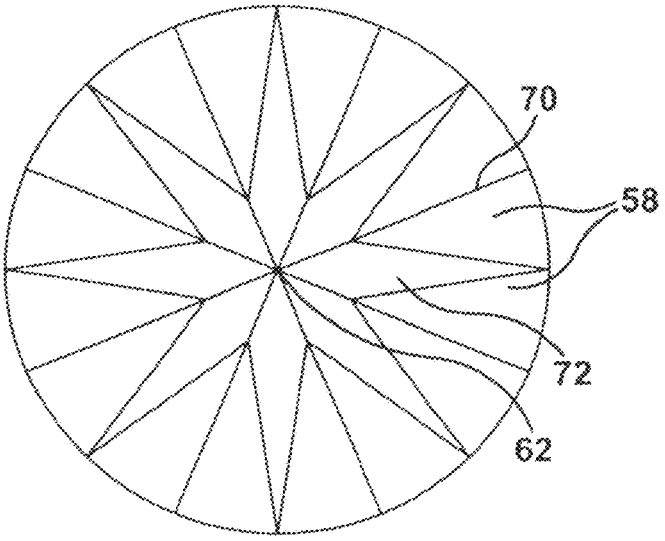
FIG. 11 is a view of a pavilion of a gemstone in an embodiment of the present invention.

As illustrated in FIGS. 6A and 11, the pavilion 60 is divided by a keel line 70. The pavilion 60 may comprise a circumferential succession of facets, including but not limited to, the lower girdle facets 58, main pavilion facets 72, and a culet 62 if needed. In an embodiment, the gemstone 40 may have eight of the main pavilion facets 72 and sixteen of the lower girdle facets 58.

Figure 7:
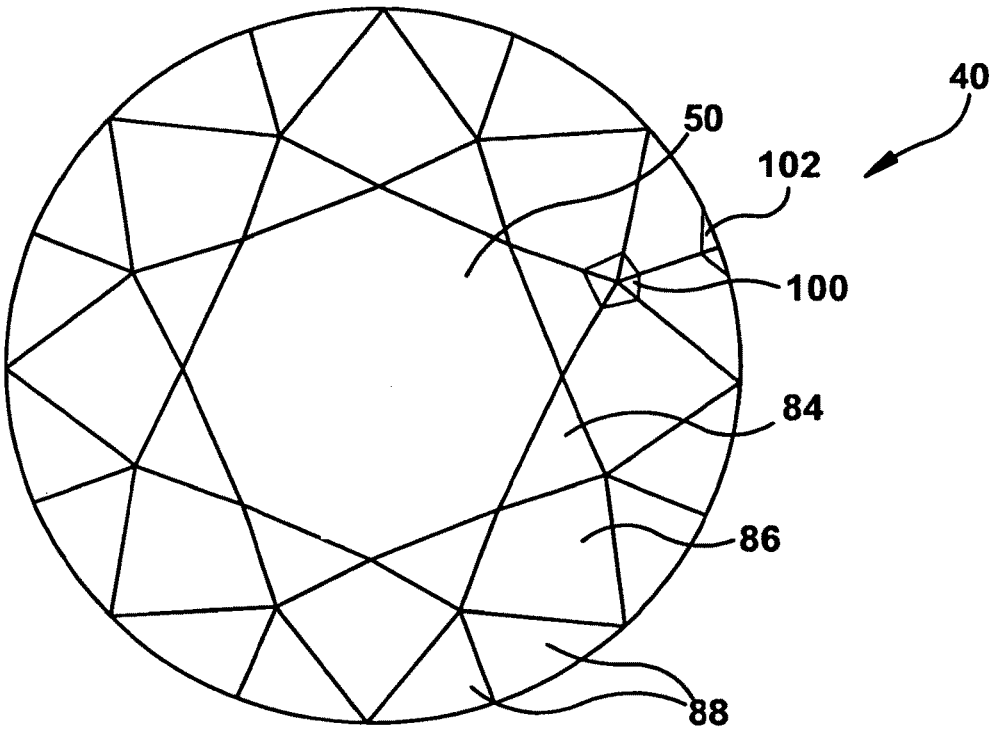
FIG. 7 illustrates a top view of the gemstone of FIG. 6 in an embodiment of the present invention.

A crown 80 is an upper portion of the gemstone 40 adjacent the first end 42 as shown in FIGS. 6A and 7. The crown 80 may converge from the girdle 52 and terminate at the table 50. In an embodiment, the table 50 extends from the girdle 52, such as from the top edge 53*a* of the girdle 52. The crown 80 may have a circumferential succession of facets, including but not limited to star facets 84, bezel facets 86 and upper girdle facets 88. For example, the crown 80 may have eight of the star facets 84, eight of the bezel facets 86, and sixteen of the upper girdle facets 88.

The gemstone 40 may, in an embodiment, have thirty-two facets on the crown 53, a facet on the table 50, twenty-four facets on the pavilion 60. Accordingly, the gemstone 40, in such an embodiment, may have a total of fifty-seven facets. In one embodiment, the gemstone 40 may have fifty-eight facets where the additional facet is the culet 62.

The culet 62 may be a faceted point at the second end of the gemstone 40. The pavilion 60 may converge and terminate at the culet 62. The pavilion 60 may diverge from the culet 62 and terminate at the girdle 52.

FIGS. 6A and 7 illustrate additional facets, namely facet 100 and facet 102. The facet 100 may be located at any intersection of one of the star facets 84, one of the bezel facets 86, and one of the upper girdle facets 88. The facet 102 may be located at the intersection of two of the upper girdle facets 88 and/or the girdle 52. Any number of the facets 100 and the facets 102 may be provided as will be appreciated by one of ordinary skill in the art. The facets 100, 102 may be polished onto the gemstone 40 to increase scintillation or to balance the color of the gemstone 40.

The crown 53 intersects the girdle 56 at a crown angle $\theta_1$. Unlike ideal cut diamonds where the crown angle is preferably 34.5 degrees, the crown angle $\theta_1$ of the present invention is less than 34.5 degrees. In a preferred embodiment, the crown angle $\theta_1$ is less than 27 degrees, and ideally the crown angle $\theta_1$ is less than 23 degrees.

Figure 5:
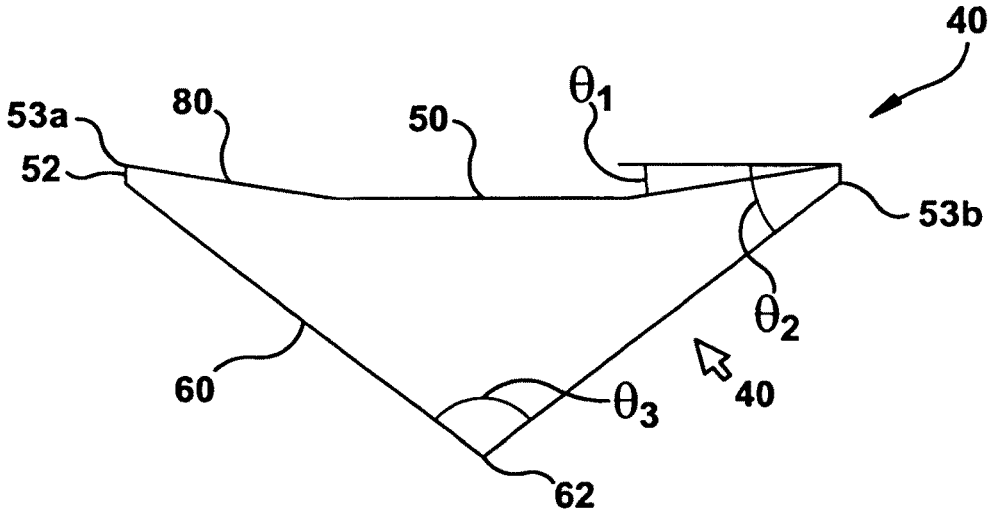
FIG. 5 illustrates a gemstone having a negative crown angle in an embodiment of the present invention.

In an embodiment, the crown angle $\theta_1$ may be zero degrees or even less than zero degrees relative to the top edge 52*a* of the girdle 52 as illustrated in FIG. 5. In such an embodiment, the table 50 is located below the top edge 52*a* of the girdle 52. Depending on the crown angle $\theta_1$, the table 50 may be located below the lower edge 53*b* of the girdle 52. The table 50 may be, for example, inverted with respect to the girdle 52.

Reducing the crown angle $\theta_1$ from the conventional ideal cut crown angle may cause a risk of chip damage to the girdle 52. As a result, the thickness of the girdle 52 may be increased to prevent risk of any damage to the girdle 52. Theoretically, the thickness of the girdle 52 has no significant effect on the brilliancy of the gemstone 40 observed from the table 50 of the gemstone 40. Accordingly, depending on the crown angle $\theta_1$ and other characteristics of the gemstone 40, the girdle 52 may be thicker than conventional ideal cut gemstones.

Figure 9A:
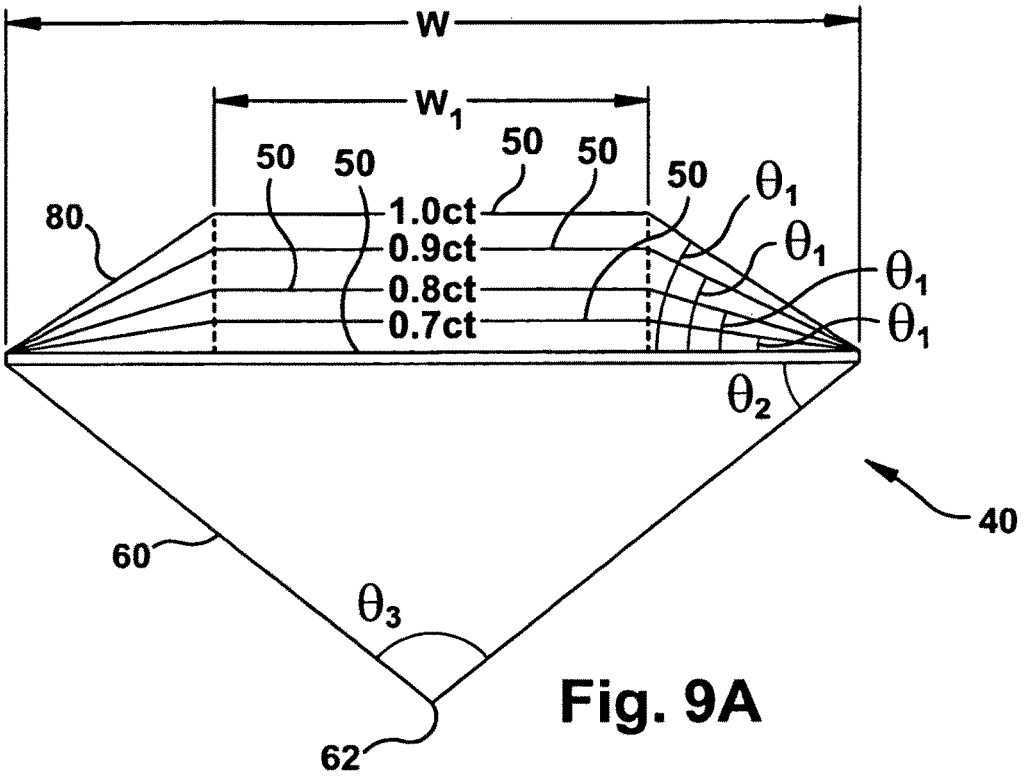
FIG. 9A illustrates a gemstone having a constant width and reduced mass by reducing the crown angle of the gemstone in an embodiment of the present invention.

Advantageously, the diameter or the width W of the gemstone 40 is maintained even if the crown angle $\theta_1$ is less than that of an "ideal cut" diamond as illustrated in FIG. 9A. To this end, the width W of the gemstone 40 may correspond to a larger gemstone than the actual weight of the gemstone 40. For example, FIG. 9A illustrates maintaining the width W of the gemstone 40 of a one carat gemstone while reducing the mass to a 0.9, 0.8 and 0.7 carat. The reduction in mass is the result of lowering the crown angle $\theta_1$ from the "ideal cut" angle to 27° to 17° to 9°. As a result, the gemstone 40 appears to be larger than its carat weight.

Figure 9B:
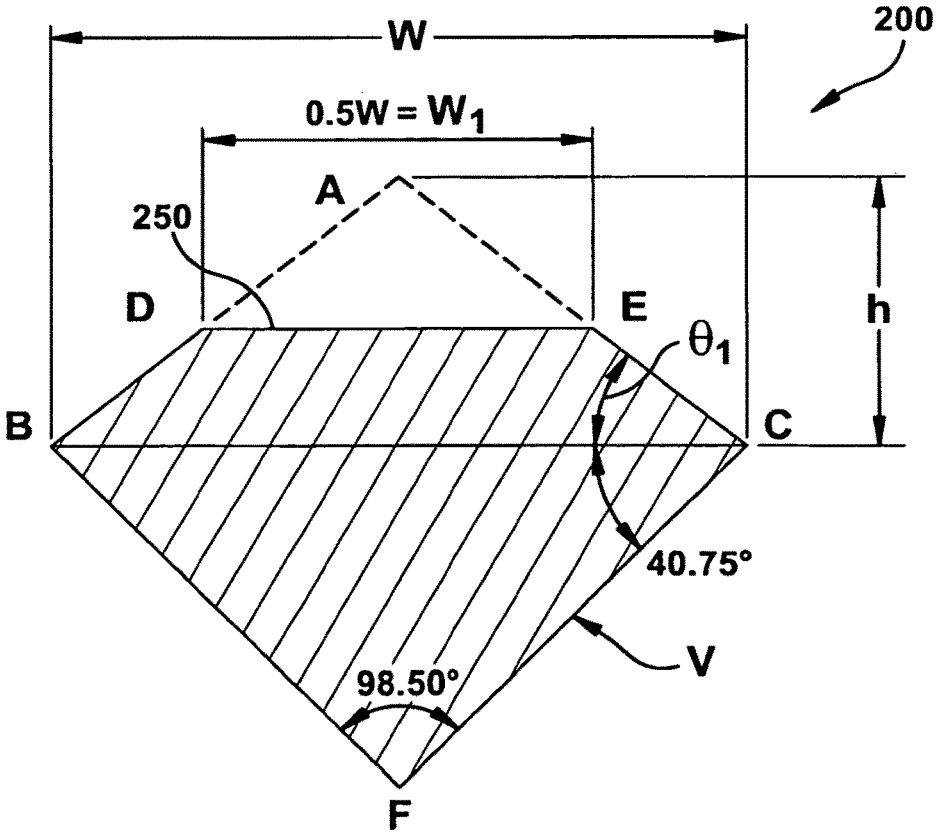
FIG. 9B is a diagram for illustrating the effect reducing the crown angle has on the volume of a gemstone in an embodiment of the present invention.

In addition, FIGS. 9B and 9C generally illustrate the effect reducing the crown angle $\theta_1$ has on the overall volume in another embodiment of a gemstone 200.

In this embodiment, the overall volume V of the gemstone 200 is calculated by the following formula:

$$V = \text{Cone } ABC - \text{Cone } ADE + \text{Cone } BFC$$

$$= (1/3\pi \cdot 0.5L\hat{}2 \cdot 0.5L \tan\theta_1) - (1/3\pi \cdot 0.25L\hat{}2 \cdot 0.25L \tan\theta_1) + (1/3\pi \cdot 0.5L\hat{}2 \cdot 0.5L\tan 40.75°)$$

As shown in FIG. 9B, the shaded area illustrates the volume V of the gemstone 200. For this illustration, the pavilion angle is maintained at 40.75°, the culet angle is maintained at 98.5°, and the table size WI is maintained at 50% of the total width W of the gemstone. Moreover, for simplification purposes and showing only relative differences, and for the purposes of this illustration only, the overall width W is maintained at 1 millimeter. Thus, for the purpose of this illustration, the only variable being adjusted is the crown angle $\theta_1$. FIG. 9C is a table showing the actual volume and change in volume resulting from reducing the crown angle $\theta_1$. In FIG. 9C, column $\theta_1$ is the crown angle in question; column "V" is the actual volume of the gemstone 200 having the crown angle $\theta_1$ in question, which is calculated in accordance with the previously discussed formula and parameters. Column "Comp" is the relative difference in volume V between a gemstone having the crown angle $\theta_1$ in question and an ideal cut gemstone having a crown angle of 34.5° (i.e., the gemstone shown in the first three columns of the first row). As will become apparent, decreasing the crown angle $\theta_1$ reduces the volume V of the gemstone 200. Nevertheless, the width W of the gemstone 200 and width WI of the table 250 may correspond to larger gemstone than the actual volume of the gemstone 200. As a result, the gemstone 200 may appear larger than its actual volume.

By reducing the mass and volume of each of the gemstones 40, more gemstones or larger gemstones may be cut from a given rough gemstone. In addition, gemstone cutters may be able to produce relatively higher quality gemstones by focusing on the width W of the gemstone 40 rather than the carat weight of the gemstone 40. Therefore, the present invention allows improved usage of rough gemstone as well as producing less expensive and higher quality gemstones.

Advantageously, changing the crown angle $\theta_1$ of the gemstone 40 improves the brilliance of the gemstone 40.

Figure 1:
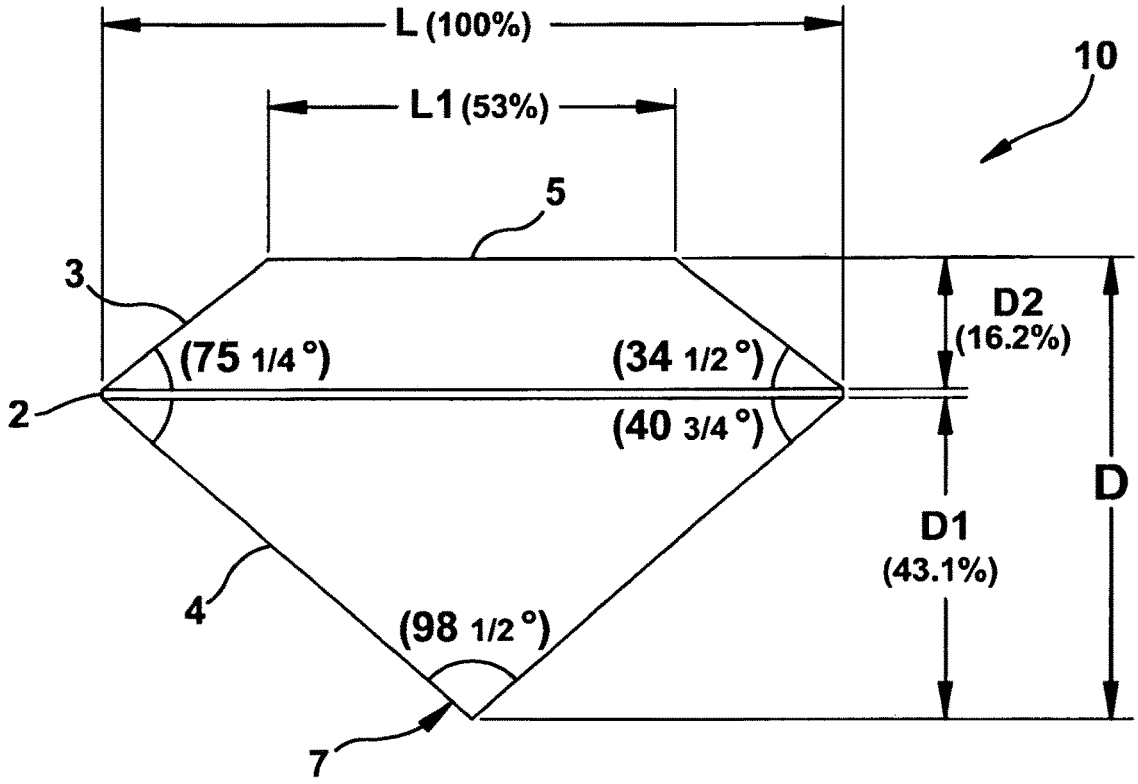
Fig. 1 PRIOR ART
FIG. 1 illustrates an ideal round cut diamond having a crown angle of 34.5°.
Figure 2A:
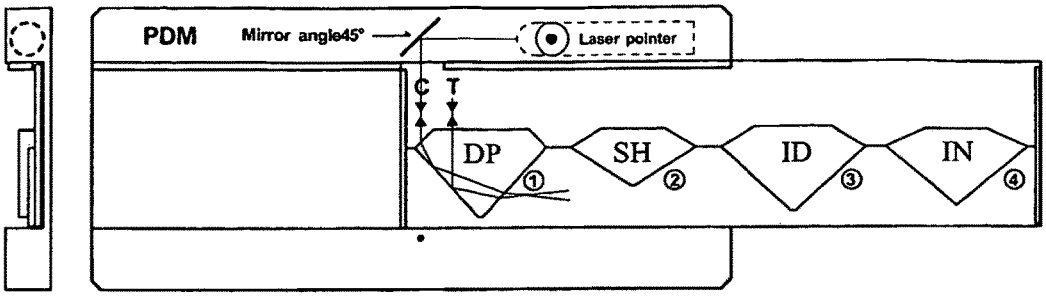
FIG. 2A illustrates light reflecting through a round cut diamond that is deeper than the ideal round diamond cut proportions.
Figure 2B:
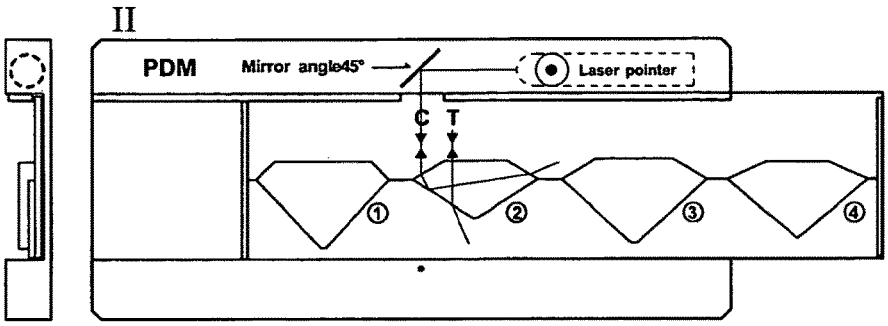
FIG. 2B illustrates light reflecting through a round cut diamond that is shallower than the ideal round diamond cut proportions.
Figure 2C:
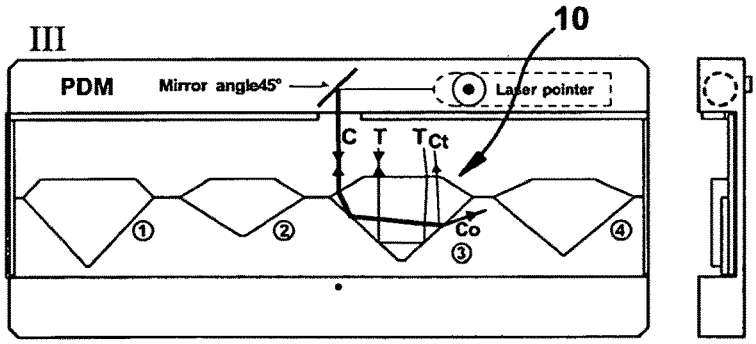
FIG. 2C illustrates light reflecting through an ideal cut round diamond.
Figure 2D:
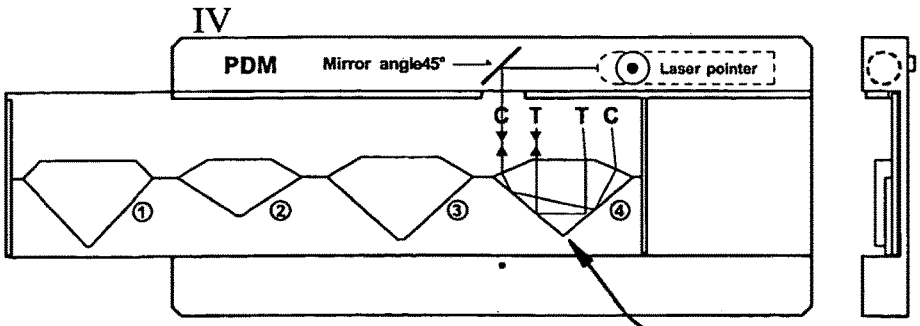
FIG. 2D illustrates light reflecting through a gemstone having a crown angle less than that of an ideal round cut diamond in an embodiment of the present invention.
Figure 3A:
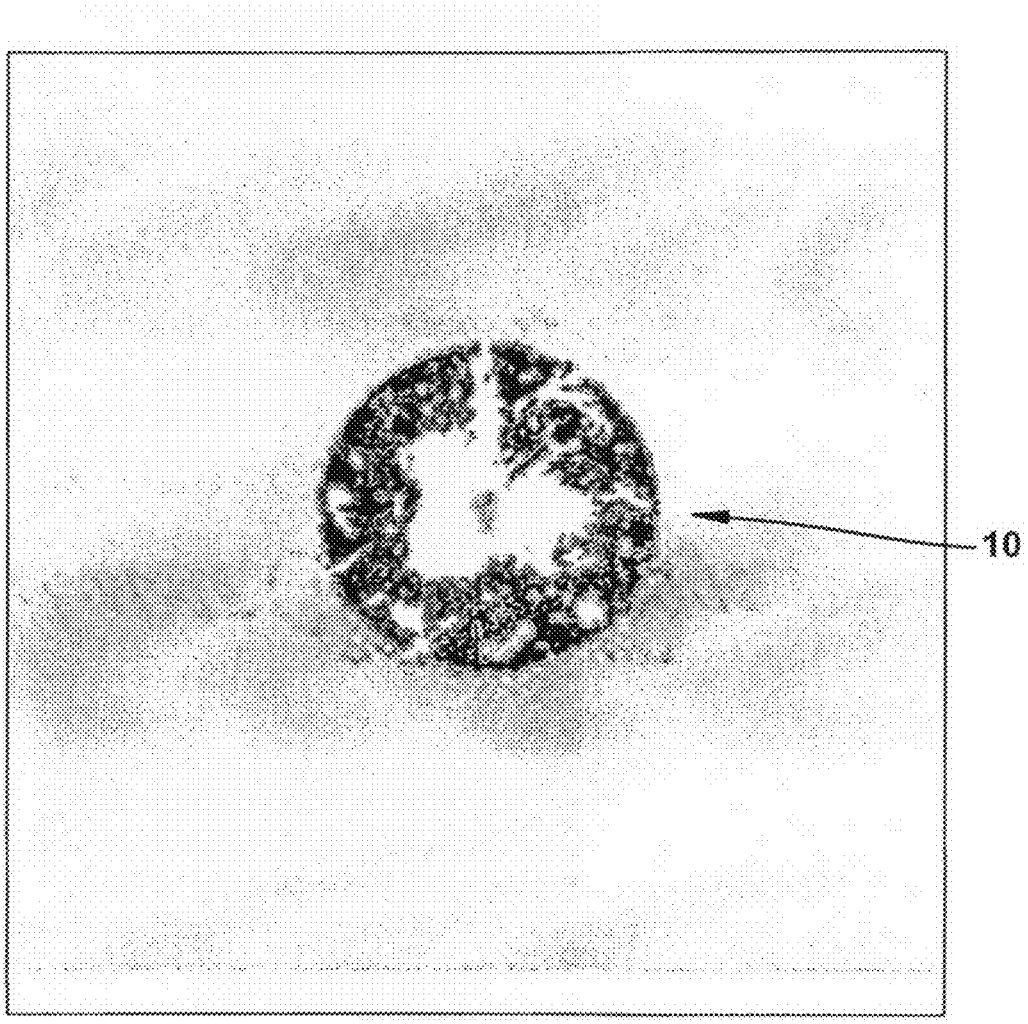
FIG. 3A illustrates an ideal round cut diamond having a brilliant table and a darker crown.
Figure 3B:
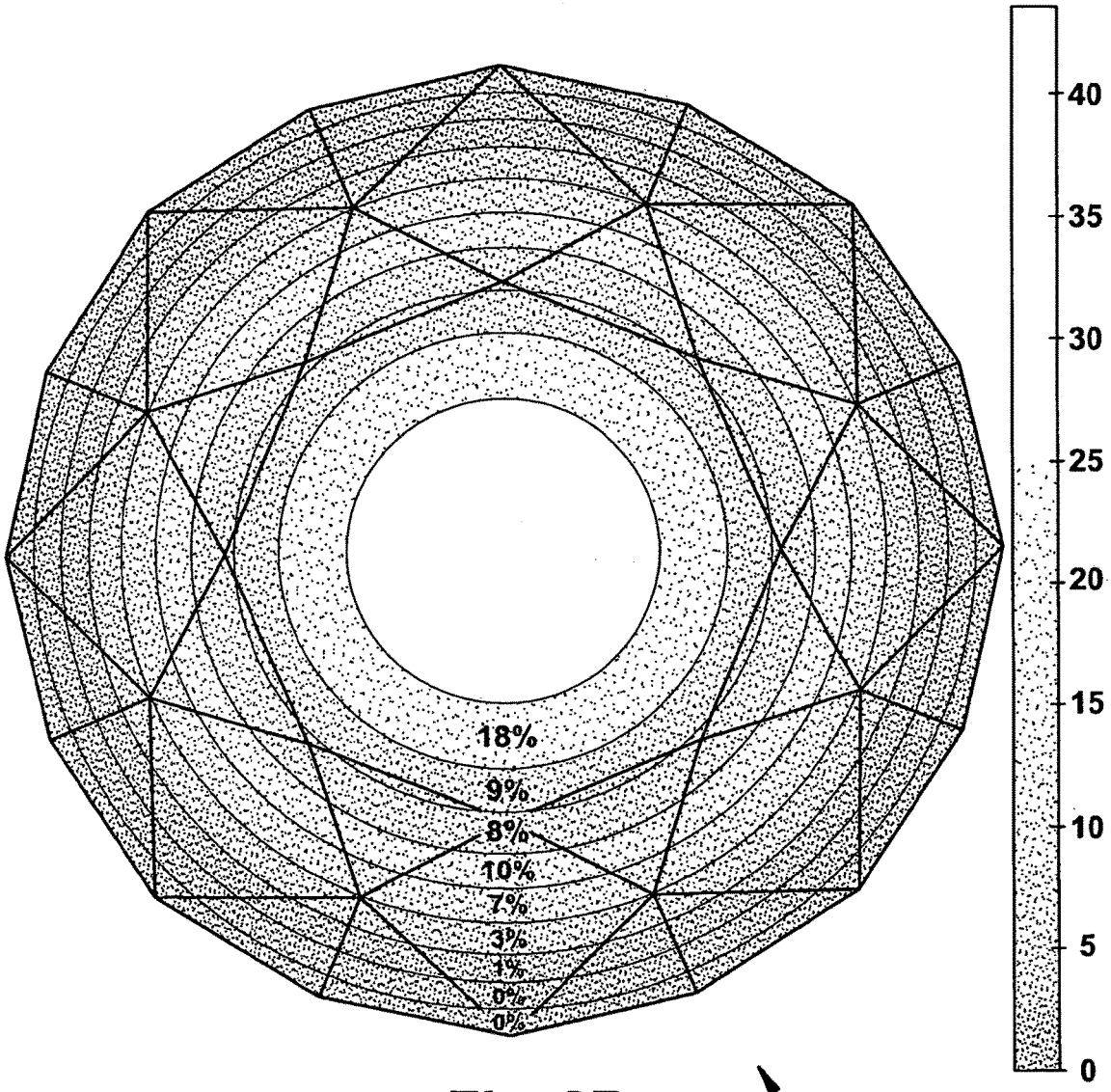
FIG. 3B illustrates a brilliancy distribution of a ideal round cut diamond showing the dark crown of the diamond.
Figure 10:
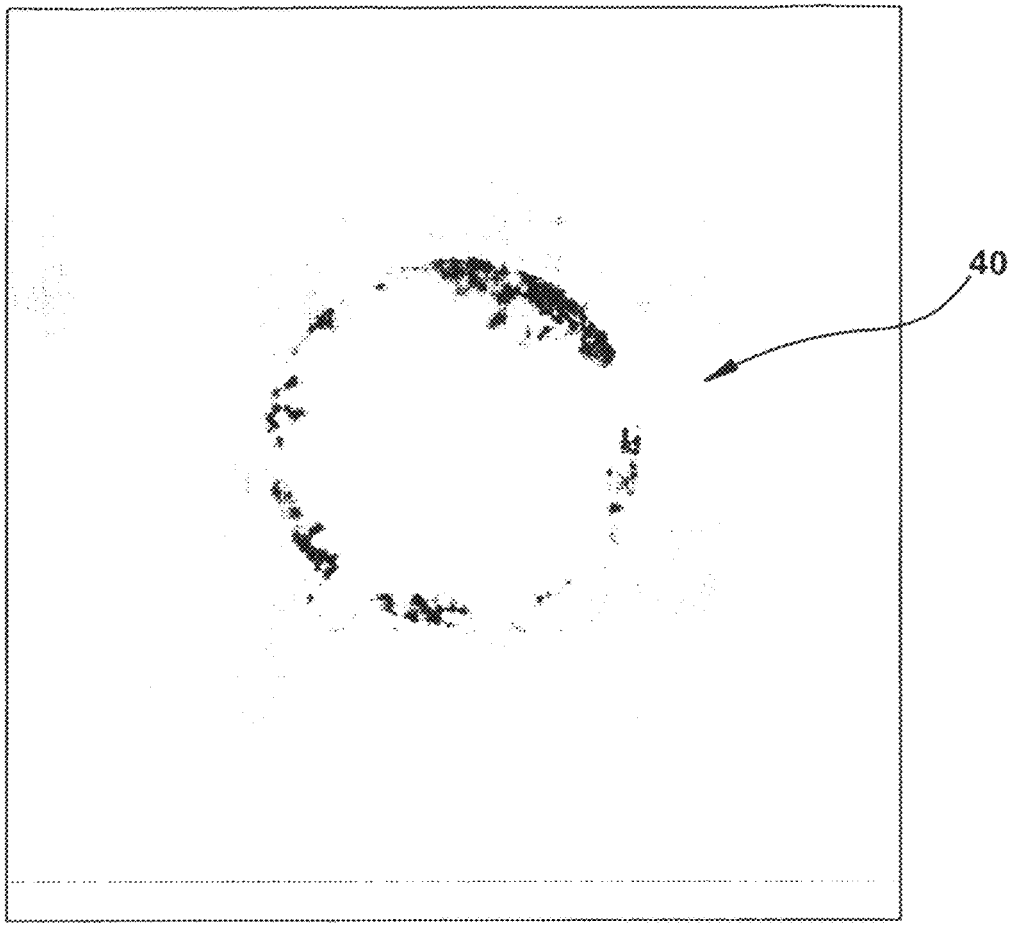
FIG. 10 is a representation of a gemstone having increased brilliance at the crown in an embodiment of the present invention.

FIG. 10 illustrates the improved brilliance of the gemstone 40 where the crown angle $\theta_1$ is less than 27°. By reducing the crown angle $\theta_1$ to be less than the 34.5° of the ideal diamond cut, the gemstone 40 gains more brilliancy of the diamond by brightening the dark crown portion of the conventional ideal cut diamond. Reducing the crown angle $\theta_1$ guides light entering from one side of the crown 80 to the opposite side of the crown 80. For example, light may enter the crown 80, reflect at the bottom pavilion 60, and return to the opposite side of the crown 80. The ideal cut round diamond having the crown angle $\theta_1$ equal to 34.5° is unable to direct light from one side of the crown 80 to the opposite side of the crown 80 (hereinafter "the CC light"). FIG. 2D, for example, illustrates the gemstone 40 where the crown angle $\theta_1$ is less than 27° causing the gemstone 40 to emit the CC light. By contrast, FIG. 2C illustrates an ideal cut round diamond that is incapable of emitting the CC light. As a result, the ideal cut round diamond has darker crown regions.

Figure 8A:
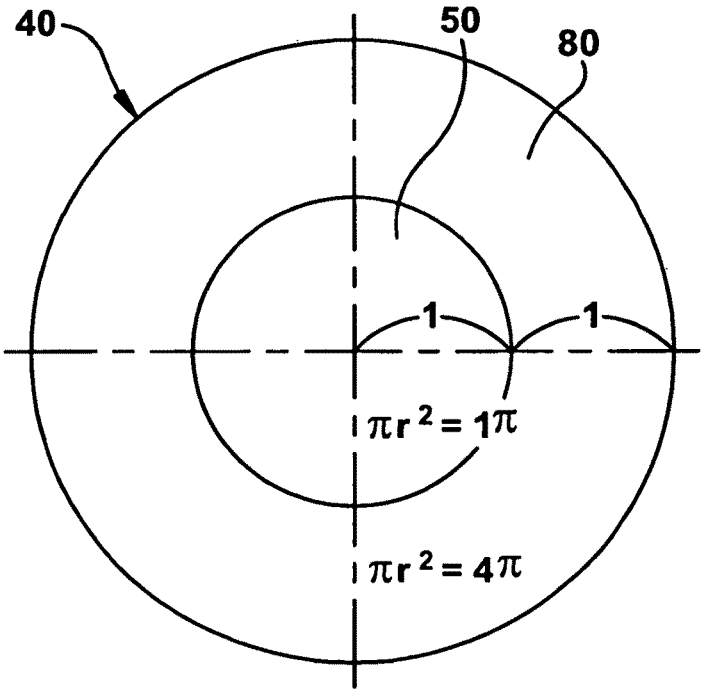
FIG. 8A is a diagram for illustrative purposes of a gemstone in an embodiment of the present invention.
Figure 8B:
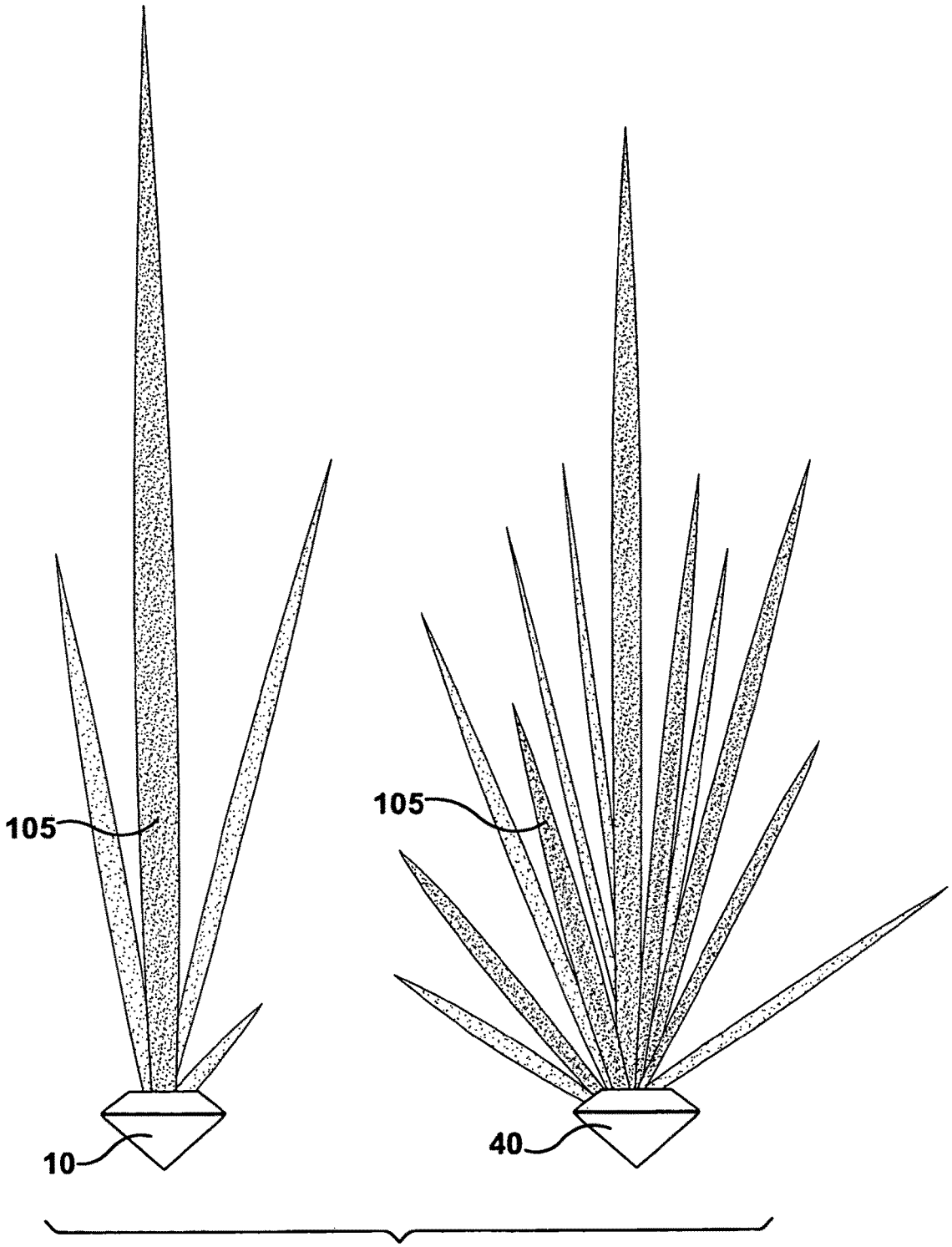
FIG. 8B illustrates the difference in brilliance between an ideal cut gemstone and a gemstone in accordance with an embodiment of the present invention.

FIG. 8A illustrates an example of how increasing the brightness of the gemstone 40 at the crown 80 greatly enhances the overall brilliance of the gemstone 40. In FIG. 8A, the gemstone is a round cut gemstone having a radius of 2 millimeters and the table 50 is 50% of the total width W (diameter) of the gemstone 40. In such an example, the area of the table 50 and the crown 80 is $\pi r^2$, where the radius of the table 50 is 1 millimeter and the radius of the crown 80 is 2 millimeters. Accordingly, the area of the table 50 is approximately $\pi$ while the area of the crown 80 is approximately $4\pi$. Therefore, because the area of the crown 80 is at least three times the area of the table 50, increasing the brilliance of the crown 80 can cause the overall brilliance to increase significantly. FIG. 8B illustrates the significant difference in brilliance between an "ideal cut" gemstone 10 and an embodiment of the present gemstone 40. As is clearly visible, the light 105 emitted from the "ideal cut" gemstone 10 is significantly less than the light 105 emitted from the embodiment of the present gemstone 40.

Reduction of the crown angle $\theta_1$ to, for example, less than 27° not only brightens the crown 80 but also improves color grading and improves clarity grading. The color of the gemstone 40 in the case of a diamond is a measure of the whiteness of the diamond. For example, a one carat diamond having a K color may improve to a G or H color grading based on the improved brilliance of the gemstone 40. The clarity of the gemstone 40 may be improved, especially in the grading region of VVS and VS as the smaller inclusions are masked by the strong excess light returning to the crown.

The gemstone 40 cut according to the specifications also maintains the light emissions common to an ideal cut round diamond, namely the table to table light (hereinafter "the TT light"). Unlike an ideal cut diamond where only a portion of the light entering the crown is reflected towards the table (hereinafter "the Ct light"), in a gemstone 40 cut according to the specifications, light entering the crown 80 is reflected from the immediate pavilion 60, to the opposite pavilion 60 and is emitted from the opposite side of the crown 80. Thus, the TT light may enter from the table 50, reflect at the pavilion 60, and emit from the table 50; and, the crown-to-crown light (hereinafter the "CC light") may enter from the crown 80, is then reflected at the pavilion 60, and is emitted from the other side of the crown 80.

The invention has been described above and, obviously, modifications and alternations will occur to others upon a reading and understanding of this specification. The claims as follows are intended to include all modifications and alterations insofar as they come within the scope of the claims or the equivalent thereof.

What is claimed is as follows:

1. A circular-cut gemstone comprising:

a girdle having a top edge and a lower edge;

a crown extending from the girdle's top edge at a crown angle less than 23 degrees so that a substantial portion of light entering one side of the crown exits an opposite side of the crown; and a pavilion extending downward from the girdle's bottom edge and having a pavilion angle the same as an ideal-cut-diamond.

2. A circular-cut gemstone as set forth in claim 1, wherein the crown angle is less than 19°.

* * * * *